US005150843A

United States Patent [19]

Miller et al.

[11] Patent Number: 5,150,843

[45] Date of Patent: Sep. 29, 1992

[54] APPARATUS AND METHOD FOR PROCESSING SOLID WASTE

[75] Inventors: Charles R. Miller, Houston; Haskell B. Berry, Jr., Channelview; Tod S. Johnson, Clear Lake Shores, all of Tex.

[73] Assignee: Premier Medical Technology, Inc., Houston, Tex.

[21] Appl. No.: 639,214

[22] Filed: Jan. 9, 1991

[51] Int. Cl.[5] ..... B02C 18/22

[52] U.S. Cl. ..... 241/27; 241/73; 241/199.12; 241/224; 241/282; 241/236

[58] Field of Search ..... 241/99, 236, 166, 167, 241/73, 243, 199.12, 222, 224, 280, 282, DIG. 38, 27, 30

[56] References Cited

U.S. PATENT DOCUMENTS

| | | | |
|---|---|---|---|
| 2,026,049 | 12/1935 | Lasch et al. | 241/199.12 X |
| 3,330,088 | 7/1967 | Dunlea, Jr. . | |
| 3,547,577 | 12/1970 | Lovercheck . | |
| 3,654,048 | 4/1972 | Bathgate . | |
| 4,185,973 | 1/1980 | Tester . | |
| 4,385,732 | 5/1983 | Williams | 241/73 X |
| 4,664,323 | 5/1987 | Ahonen et al. | 241/282 |
| 4,844,363 | 7/1989 | Garnier et al. | 241/236 X |

FOREIGN PATENT DOCUMENTS

| | | | |
|---|---|---|---|
| 476829 | 5/1929 | Fed. Rep. of Germany | 241/199.12 |
| 948 | of 1888 | United Kingdom | 241/199.12 |

*Primary Examiner*—Timothy V. Eley

*Attorney, Agent, or Firm*—Fleit, Jacobson, Cohn, Price, Holman & Stern

[57] ABSTRACT

Apparatus for processing solid waste includes a chamber for receiving the waste, which may be any contaminated or non-contaminated waste including paper, plastics, cloth, metal and hospital sharps, and a ram for forcing the waste, to which germicide may be added, into contact with a plurality of cutting heads. The cutting heads which shred, shear and cut the waste are each mounted on an elongated rotating shaft. Each cutting head includes a plurality of parallel cutting blades separated by spacers. Adjacent cutting heads mesh together so that cutting blades of one cutting head interdigitate with spacers of an adjacent cutting head. A pair of curved doors close the chamber closely adjacent the cutting heads while the waste is being cut, and are opened for releasing the cut waste. The doors include elongated parallel grooves alternately for receiving the cutting edges of the cutting blades and for receiving the spacers. A dislodging plate is fixed centrally, adjacent the inward edges of the curved doors when the doors are closed. The dislodging plate is grooved continuously with the grooves on the doors, likewise for receiving the alternating cutting edges of the cutting heads and the spacers. The shredded material, greatly reduced in volume, is disgorged into a container when the doors are opened after processing.

19 Claims, 4 Drawing Sheets

APPARATUS AND METHOD FOR PROCESSING SOLID WASTE

FIELD OF THE INVENTION

The invention relates to apparatus for processing contaminated solid waste for disposal.

BACKGROUND OF THE INVENTION

Previously known apparatus for processing solid waste has not been able to effectively grind the waste until it is unrecognizable while simultaneously decontaminating and drying the waste. Tester, U.S. Pat. No. 4,185,973, describes a hospital waste disposal system in which hospital waste is comminuted in a shredding machine and drawn through a vacuum system for destruction. The waste is sprayed with germicide during shredding. The apparatus is pneumatically controlled. Dunlea, Jr., U.S. Pat. No. 3,330,088, describes a method of bulk rubbish disposal in which the rubbish is ground, optionally mixed with a liquid adhesive such as liquid asphalt, compacted and charged for disposal. The exposed surfaces of the compacted mass may be coated to prevent water penetration if the compacted bundles are disposed of at sea. Lovercheck, U.S. Pat. No. 3,547,577, describes a refuse sterilization system in which domestic refuse is shredded, compressed and sterilized using a wheel-mounted shredder. The process includes heating the refuse to form briquettes. U.S. Pat. No. 3,654,048 to Bathgate, describes a method of compacting shredded municipal refuse using bitumen as an adhesive for the shredded, baled material.

SUMMARY OF THE INVENTION

Apparatus for processing solid waste includes a chamber for receiving the waste, which may be any contaminated or noncontaminated waste including paper, plastics, cloth, metal and hospital sharps, and a ram for forcing the waste, to which germicide may be added, into contact with a plurality of cutting heads. The cutting heads which shred, shear and cut the waste are each mounted on an elongated rotating shaft. Each cutting head includes a plurality of parallel cutting blades separated by spacers. Adjacent cutting heads mesh together so that cutting blades of one cutting head interdigitate with spacers of an adjacent cutting head. A pair of curved doors close the chamber closely adjacent the cutting heads while the waste is being cut, and are opened for releasing the cut waste. The doors include elongated parallel grooves alternately for receiving the cutting edges of the cutting blades and for receiving the spacers. A dislodging plate is fixed centrally, adjacent the inward edges of the curved doors when the doors are closed. The dislodging plate is grooved continuously with the grooves on the doors, likewise for receiving the alternating cutting edges of the cutting heads and the spacers. The shredded material, greatly reduced in volume, is disgorged into a container when the doors are opened after processing.

DETAILED DESCRIPTION OF THE INVENTION

The invention pertains to waste processing apparatus. The apparatus may be used for any material, either contaminated or noncontaminated, including infectious agents, biohazardous material, hazardous chemicals, radionuclides and contaminated solid waste materials such as paper, plastics, rubber, woven materials, glass, bottles or tubes and hospital sharps. The apparatus is designed to achieve simultaneously both physical destruction and volume reduction of the solid waste materials by shredding, shearing and cutting, and efficiently mixing the shredded waste materials With either liquid or dry powdered chemicals introduced into the machine with the waste materials for the purpose of chemical disinfection and/or neutralization and stabilization of contaminated waste materials. The waste material is comminuted to a dry material which is rendered unrecognizable by using the apparatus as intended. The material may be reduced to about 15 to 25 percent of the original volume.

Figure 2A:
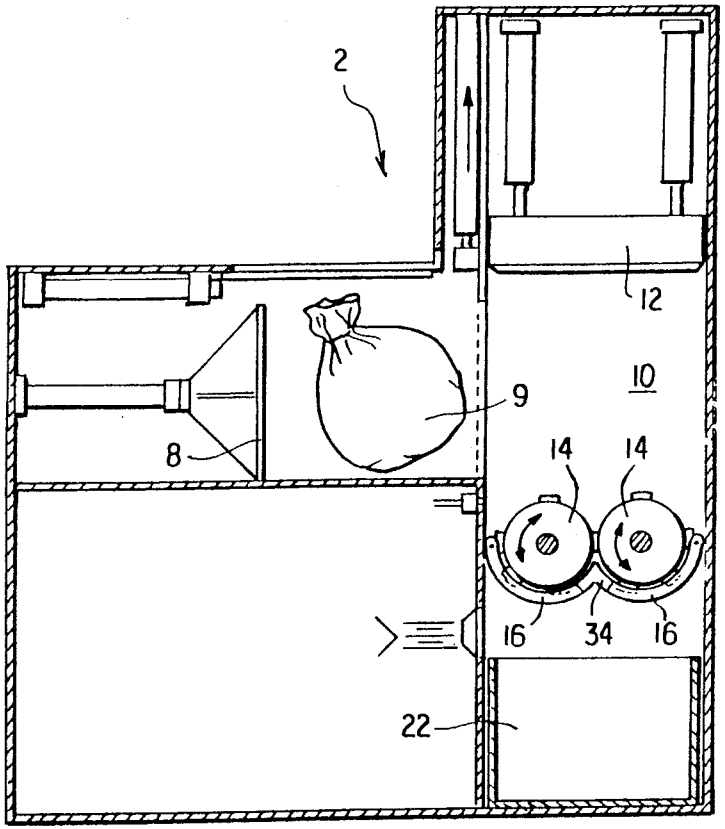
FIGS. 2A, 2B, 2C and 2D schematically show the operating sequence of the apparatus.
Figure 1:
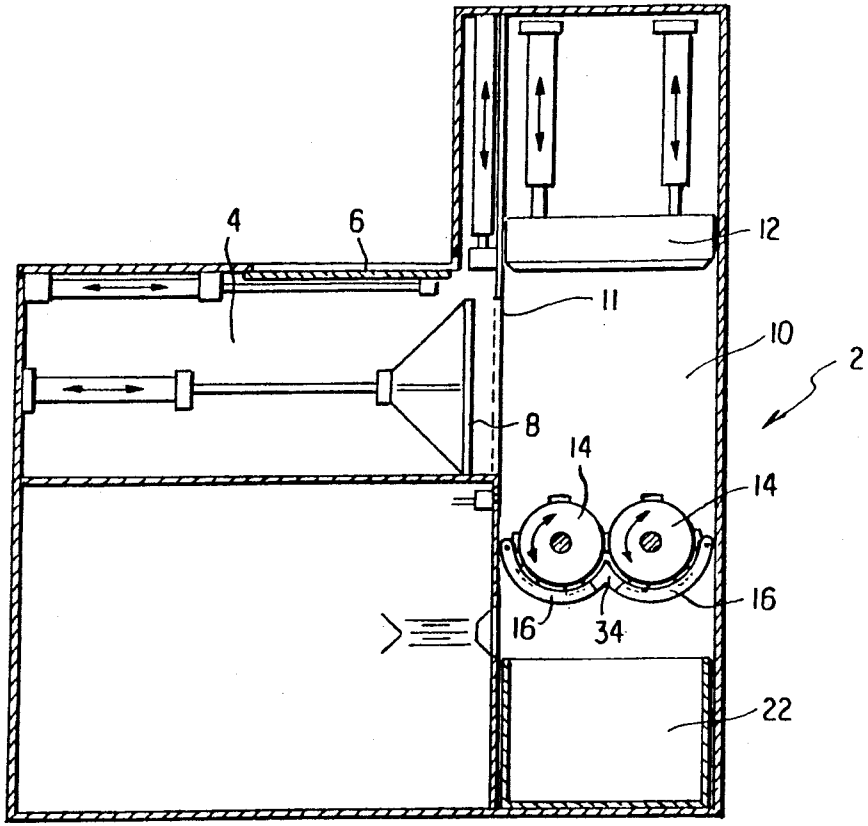
FIG. 1 is a schematic representation of apparatus for processing solid waste.
Figure 2C:
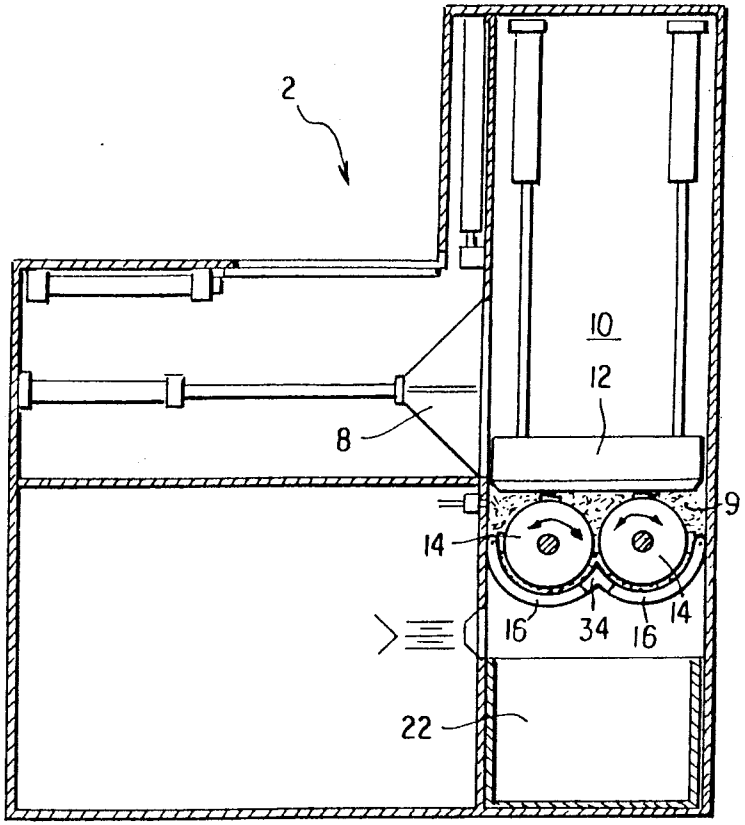
Figure 2B:
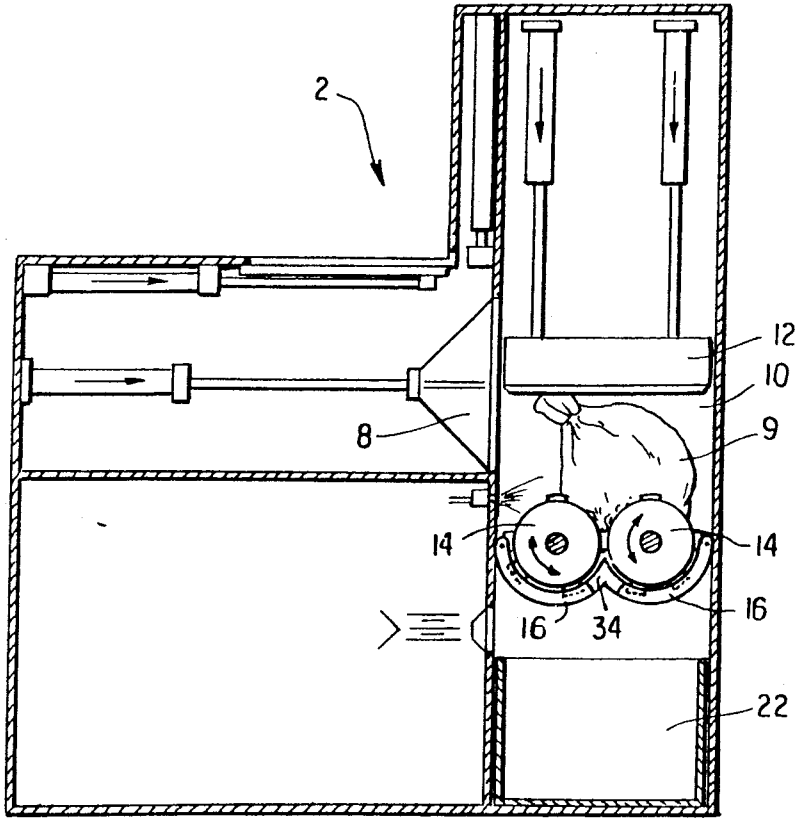
Figure 3:
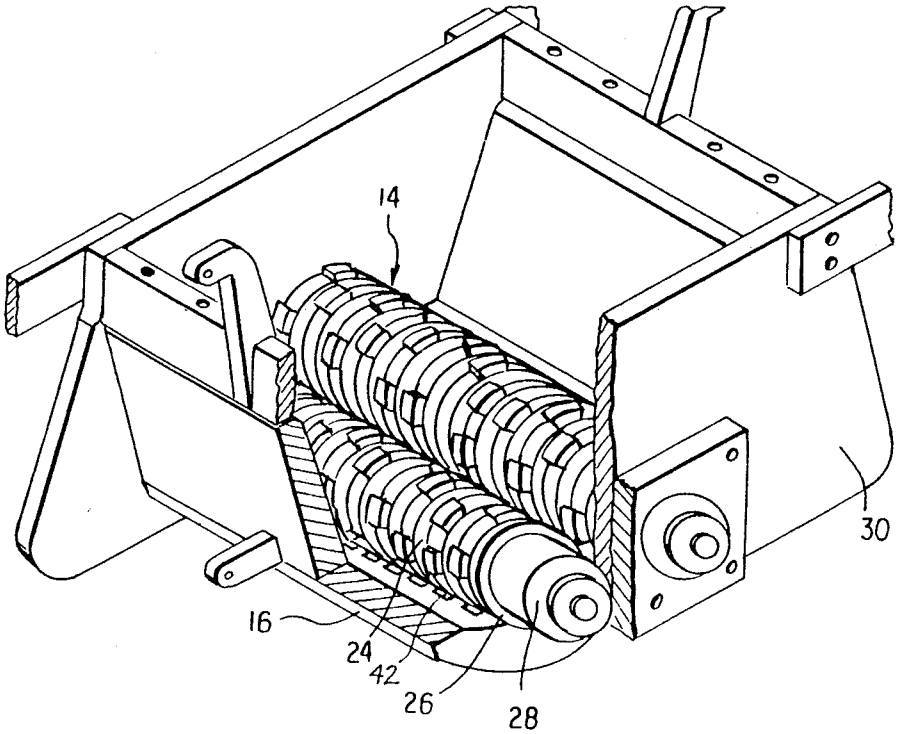
FIG. 3 is a schematic view of the shredding and shearing assembly.
Figure 5:
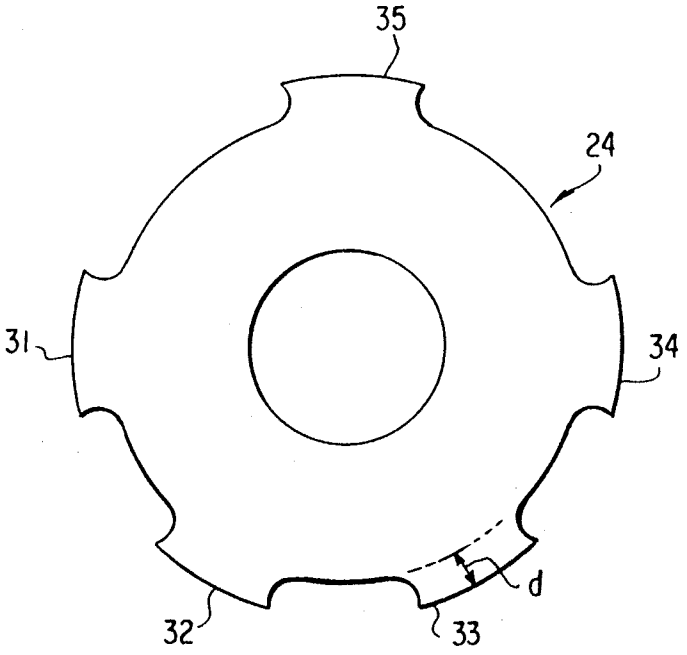
FIG. 5 is a plan view a typical cutting blade used in the shredding/shearing assembly of the apparatus.
Figure 4:
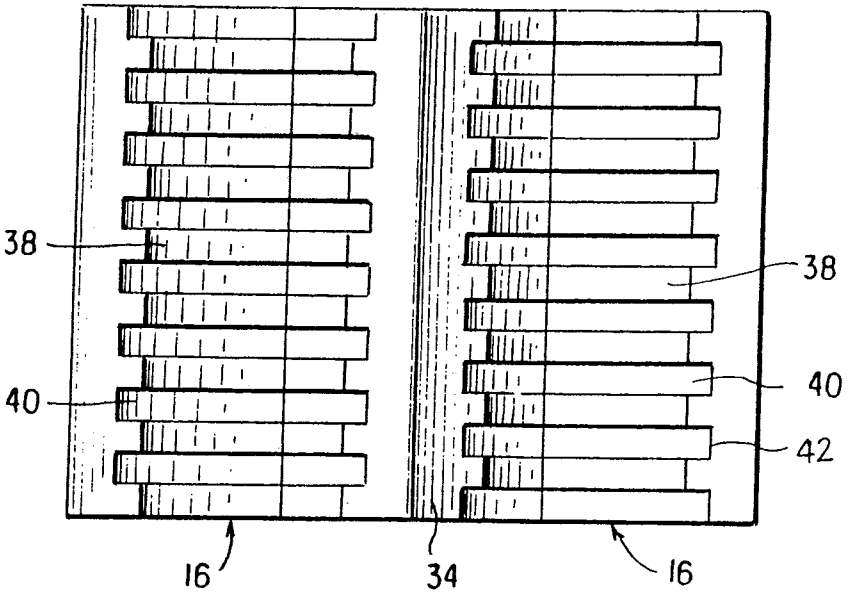
FIG. 4 is a top plan view of parallel grooves of assembly doors and a dislodging plate of the apparatus.

FIG. 1 shows a schematic view of a single chamber shredding/mixing apparatus of the invention having a shredding/shearing assembly as shown in FIGS. 3, 4 and 5. The apparatus operates in batch mode, as depicted schematically in FIGS. 2A, 2B, 2C and 2D.

With reference to the Figures, in which like numerals represent like parts, bags or boxes of waste materials to be comminuted are introduced into closed waste chamber 4 of apparatus 2 through hydraulically operated safety gate 6. The waste material is then forced by a hydraulic ram 8 into containment chamber 10 for processing. Activation of a power switch starts the batch processing cycle. A fan maintains negative pressure inside the machine relative to atmospheric pressure and pulls air and airborne particles through a filter system (not shown) which may be a particle removing pre-filter and HEPA-filter to eliminate potential aerosol biohazard safety problems and noxious odors prior to exiting the machine.

The waste materials 9 which enter containment chamber 10 through hydraulically operated door 11 are forced by ram plate 12 toward rotating cutting heads 14. Ram plate 12 is positioned at the top of containment chamber 10 at the start of each batch cycle (FIG. 2A), then moves progressively towards a fixed point above cutting heads 14 (FIG. 2B) during processing and operates by pressing the waste material against cutting heads 14 for shredding. Ram plate 12 forms the upper barrier of containment chamber 10 during processing and is lowered from the position shown in FIG. 2A to the position shown in FIG. 2C during each batch cycle. Ram plate 12 promotes shredding, shearing and cutting of the solid waste materials by forcing the waste materials against cutting heads 14, in addition to facilitating materials mixing dynamics.

As ram-plate 12 moves towards cutting heads 14, the apparent volume of containment chamber 10 decreases. This forces the waste material toward the cutting heads and enhances the mixing action of the waste materials. Contaminated waste material is efficiently physically destroyed, reduced in volume and mixed during processing. In addition, by introducing an appropriate liquid or dry powder germicide into containment chamber 10 just prior to or with the contaminated waste material, the germicide will be mixed with the shredded waste material for chemical disinfection and/or neutralization and stabilization of contaminants, depending on the type of contaminants present and the chemicals used.

Assembly doors 16 form the lower sides and bottom section of the shredding/shearing assembly and are hinged to end plates 18 at hinges 20. Assembly doors 16 swing to an "open" position, shown in FIG. 2D at the end of each batch cycle so that the processed waste materials can be mechanically transferred or dumped into a waste container 22 located below the shredding/shearing assembly. Cutting heads 14 continue to rotate during material dumping to mechanically transfer the material to waste container 22.

The assembly doors are closed during processing and the rotating cutting heads undergo self cleaning by the close tolerance restraints of cutting heads to each other, close tolerance to the spacers of the adjacent cutting head, and by traversing the assembly doors and dislodging plate grooves momentarily after dumping the waste materials. Following dumping, the assembly doors spring back into their original closed, locked position to form the lower sides and bottom sections of the shredding, shearing assembly, shown in FIG. 3. The ramplate then returns to the original starting position at the top of the containment chamber, as shown in FIG. 2A. The machine is then ready to start another batch cycle.

Cutting heads 14, shown in FIGS. 3 and 5, have a circular core and a series of disc-shaped shredding, shearing and cutting blades mounted on a supportive shaft positioned in the core, with spacers positioned between each cutting blade. Cutting head 14, shown in FIG. 3, has a series of blades 24 with spacers 26 positioned alternately between the blades. Cutting head 14 is mounted on shaft 28 which is mounted to end plates 30 of the apparatus.

Cutting blades 24 may each be of the same blade configuration or may be of different configurations. Different configurations of blade may be used on a cutting head as long as the blade depth d, shown in FIG. 5, remains substantially constant for each separate blade 24. Cutting blade 24, shown in FIG. 5, has five cutting surfaces 31, 32, 33, 34 and 35, extending from the body of cutting blade 24 by a distance d. The circumferential spacings between cutting surfaces 31 and 32, between cutting surfaces 32 and 33 and between cutting surfaces 33 and 34 are all substantially equal. Cutting surface 35 is more remotely spaced from adjacent cutting surfaces 31 and 34 as it has been found that an asymmetric cutting head substantially prevents problems of grabbing of plastics and provides a better and more even cutting action. Cutting heads 24 are alternated with spacers 26 which have a diameter smaller than cutting blade 24 to receive the cutting blades of the adjacent cutting head 14. While asymmetric cutting blades, as shown in FIG. 5, are generally preferred, symmetrical cutting blades may be used.

Cutting blades made of hardened steel alloy, of equal width and either similar or dissimilar outside diameter are arranged on splined stainless steel shafts, interspersed with spacers of the same width. The outer shredding, shearing surface of each cutting blade comes in close tolerance with the outer, flat edge of a spacer positioned on an adjacent shaft and interdigitates with the shredding, shearing surface edges of two cutting blades on the adjacent shaft(s). In addition, the outer shredding, shearing surfaces of each cutting head fits in and traverses through (during each 360 degree rotation) a groove in the inner surface of the assembly doors and dislodging plate.

The assembly doors are hinged on the end plates such that the radius of swing allows the semi-circular sections of the assembly doors to close together tightly under the cutting heads. The inner surface of the semicircular assembly doors are grooved to fit the outside diameter and angle of each cutting head. The cutting heads also fit into the grooves of the assembly doors and dislodging plate.

The simplest machine configuration, shown in FIG. 3, has two cutting heads 14 having cutting blades positioned alternately with spacers. Alternatively, three or four shafts can be used in a single machine to increase the material processing capacity. In the configuration shown in FIG. 3, cutting heads 14 are mounted on shafts 28. The cutting blades are arranged so that the cutting blades and spacers on the first shaft interdigitate with the cutting blades and spacers on the second shaft so that the cutting blades on the first shaft have a close cutting tolerance with the spacers on the second shaft. The cutting tolerance or spacing between the peripheral cutting surface of a cutting blade on a first shaft and the corresponding spacer on a second shaft is preferably about 5/1000 to 25/1000 inch and preferably about 8/1000 to 12/1000 inch. Similar cutting tolerances separate the outer edge of the cutting blades from the grooves in the assembly dooors and dislodging plate. Other tolerances may be useful for other materials. If the spacing is too close, jamming will occur; if the spacing is too wide, cutting will be imperfect.

The ram plate 12 serves several functions during operation. It provides a safety shield at the top of mixing chamber 10 to prohibit infectious agents, biohazards, hazardous chemicals or radioactive contaminants from escaping beyond the ram plate barrier. It also forces the contaminated solid waste materials introduced into the containment chamber toward the rotating cutting heads 14. Ram plate 12 promotes recycling dynamics of waste materials by progressively reducing the apparent volume of the containment chamber during batch operation and facilitates mixing of the waste materials in containment chamber 10 with the chemical disinfectants and/or neutralizing/stabilizing agents which may be added.

Figure 2D:
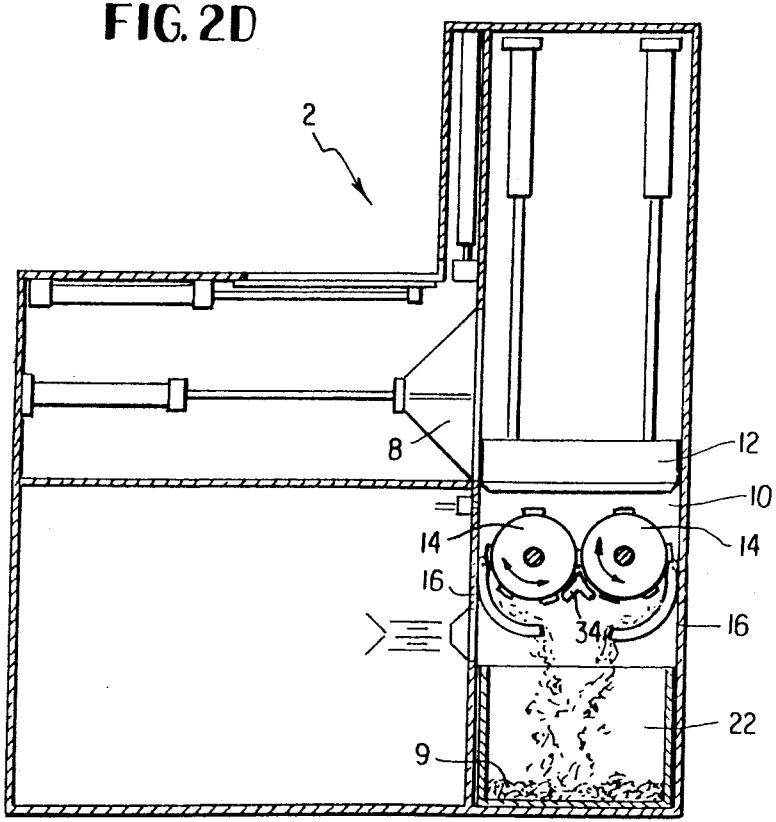

The shredding/shearing assembly 3, shown in FIGS. 1 and 3, consists of two large end plates 30 joined by rigid support bars 32 and by dislodging plate 34, shown in FIGS. 2D and 4. If assembly doors 16 extend to meet each other in the center, on opening to release shredded material, some material may lodge on doors 16 and prevent proper reclosing of the assembly doors. By providing dislodging plate 34, assembly doors 16 are shorter and do not retain shredded material. Other arrangements will be apparent to one skilled in the art. Dislodging plate 34 has grooves that match and are contiguous with the grooves of assembly doors 16 which abut each outer edge of the dislodging plate when the assembly doors are closed.

At least two cutting head units 14, each with independently powered, reversible direction shafts 28, mounted cutting blades 24 and spacers 26 are used in each shredding/shearing assembly. Cutting heads 14 are accommodated by semicircular movable assembly doors 16, shown in FIGS. 1 to 3, which include inner surface grooved channels, shown in FIG. 4, for receiving the cutting blades and spacers of the cutting heads. FIG. 4 illustrates the parallel groove pattern of assembly doors 16 and dislodging plate 34. Dislodging plate 34 extends downwardly from edge 36, as shown in FIG. 2D, when doors 16 are opened. When doors 16 are closed, doors 16 and dislodging plate 34 form a continuous curved, grooved surface, closely adjacent to cutting heads 14.

Assembly doors 16 and dislodging plate 34 are grooved to conform to the profile of the adjacent cutting heads 14. Shorter grooves 38 are for receiving spacers 26 of cutting head 14 and longer grooves 40 are for receiving cutting blades 24 of cutting head 14 which has a greater outer diameter to the edge of the blade than a spacer. Since a cutting blade of one cutting head meshes with a spacer of the adjacent cutting head, longer groove 40 in the assembly door and dislodging plate on a first side, for receiving a cutting blade, is adjacent a spacer groove 38 on the dislodging plate and assembly door on the second side. The outer and lower edges of each cutting head 14 are closely positioned in the grooves of the semi-circular profile dislodging plate and assembly doors.

When the assembly doors 16 are in the closed position and the cutting heads 14 are rotating, the upper, exposed edges 42 of assembly doors 16, shown in FIG. 3, function as cutting, shredding and shearing surfaces for cutting heads 14. Corresponding edges on the dislodging plate function similarly. During processing of solid waste material, the grooves located on the inner surface of the assembly doors 16 and the corresponding contiguous grooves on the inner surface of the dislodging plate 34 form rigid, continuous grooves or channels to recycle or return the waste materials captured by cutting heads 14, passing the waste materials back into containment chamber 10. The cutting head units are each independently powered, reversible direction shafts having mounted cutting blades. An important operating feature of the invention is the ability to conduct bi-directional shredding, shearing and cutting of the contaminated solid waste material. Cutting heads 14 function in either direction (forward or reverse) and are rapidly and repeatedly reversed in direction during each batch cycle. If shaft rotation stops, such as if there is a momentary jam during processing, the cutting heads automatically reverse direction to free the jam.

Generally, the apparatus described has application for processing a wide range of contaminated or non-contaminated solid wastes, such as paper, plastics, glass, rubber, synthetics, small metal objects, syringes and needles. Different contaminants include infectious agents, pathogens, and chemotherapy agents disposed of from hospitals, clinical laboratories, veterinarian clinics or research laboratories. Wastes may be medical infectious wastes and sharps. Other wastes which may be processed in this apparatus include infectious agents and/or genetic engineering wastes which may be decontaminated in this apparatus using an appropriate germicide. Hazardous chemicals and radionuclides may also be processed. The apparatus achieves efficient physical destruction and volume reduction. The mixing action and chemical treatment is suitable for a wide range of contaminated solid waste materials commonly generated in hospitals, research laboratories and in industry. All materials may be processed, including soft paper and plastics, aqueous liquid or blood contained in plastic or glass tubes, metal needles and scalpel blades. The apparatus can be used to process small quantities of contaminated solid waste materials or large quantities per batch cycle down to a nominal $\frac{1}{8}$ to $\frac{1}{4}$ inch mesh size, very rapidly.

The apparatus may accommodate different types and numbers of cutting heads. At least two cutting heads, mounted on adjacent shafts are needed. Three, four or more shafts with mounted cutting heads may be used, and the assembly doors and dislodging plate would be contoured appropriately. Cutting heads may consist of either a single type of cutting blade, for example, as illustrated in FIG. 5. Alternatively, two or more different types of cutting heads, of different sizes and/or shapes, may be employed in the apparatus, depending on the application. The dimensions of the shredding/shearing assembly and the grooves on the inner surface of the assembly doors and dislodging plate must fit the outside diameter width and angle specifications of the cutting heads being used, to a close tolerance fit.

During processing of contaminated solid waste materials, the assembly doors remain in the closed position (FIGS. 1 and 3). In this configuration, the parallel grooves on the inner surface of the semi-circular assembly doors and the contiguous dislodging plate grooves accommodate the outer portions of the cutting blades. There is one cutting blade per groove, with approximately the lower one-half of each cutting blade traveling in a groove at any time during operation. During process operation (i.e., assembly doors closed, cutting heads rotating) the grooves in the assembly doors and dislodging plate are aligned such that a series of parallel grooves exist (one groove per cutting blade) in the lower portion of the shredding/shearing assembly such that materials captured by the rotating cutting heads and drawn into the grooves are forced through the length of the grooves and recycled back into the containment chamber. The repetitive shredding, shearing, cutting of the waste materials yields with time smaller sized pieces of waste material. The waste materials are shredded, sheared and cut at the central axis of the cutting heads when the shaft(s) are rotating inward. The inward shaft rotation forces the captured waste materials first to be forced by the cutting heads through the grooves in the dislodging plate, then through the contiguous grooves in the assembly doors and then recycled back into the containment chamber for additional processing and mixing. When the shafts are rotating outward (reverse direction) the shredding, shearing, cutting takes place initially at the upper (or top) portion of the assembly door grooves and ridges where the rotating cutting heads enter the grooves (see FIG. 3). Waste materials captured by the outward rotating cutting heads are pulled or drawn into the assembly door grooves by the cutting heads and forced through the contiguous grooves in the dislodging plate, then forced to pass through the cutting head interdigitating zone (i.e., the region where the cutting heads on one shaft overlap and pass at close tolerance to the cutting heads on the adjacent shaft). After the waste materials pass the interdigitating zone, the wastes are mechanically forced back into the containment chamber by the rotating cutting heads. The materials are mixed and randomized with other shredded waste materials in the containment chamber and subsequently will be recaptured by the cutting heads and processed into smaller sized pieces. For any given batch cycle, contaminated solid waste materials being processed are captured numerous times by the cutting heads, thereby rendering the resulting waste materials unrecognizable and achieving a high volume reduction ratio.

To avoid cavitation problems, the apparatus has no additional voids in the lower portion of the shredding/shearing assembly. In essence other than the assembly door and contiguous dislodging plate grooves. The recycling and remixing dynamics of the waste material that is achieved in the invention during processing serves the dual purpose of achieving efficient physical destruction/volume reduction by multiple or repetitive shredding and shearing action of the same waste material and enhancing mixing action to facilitate mixing of chemical disinfectant, germicide, or chemical neutralizing/stabilizing chemicals with the shredded waste materials.

The apparatus can be used to batch process contaminated solid waste materials (i.e., simultaneously physically destroy/volume reduce and chemically disinfect and/or neutralize, stabilize the contaminated solid waste materials). Solid waste materials, ranging from small quantities to several hundred pounds per batch depending on the machine design capacity can be rapidly and cost-effectively bach processed to meet federal, state, and local health and safety regulations for the management and disposal of contaminated solid waste materials.

Contaminated solid waste materials may be chemically pretreated, autoclaved or otherwise sterilized to eliminate infectious agents and/or pathogens from contaminated waste materials. The sterilized materials may then be physically destroyed and reduced in volume using the apparatus described. Likewise, contaminated solid waste materials could first be physically destroyed and reduced in volume and then sterilized or otherwise treated. These alternative methods would require an additional processing step and material handling, and hence would be less efficient and less desirable from the point of view of safety than the process enabled using the apparatus described.

The process used is described with reference to the Figures. FIG. 2A illustrates the start of the processing cycle before the rotation of the cutting heads is started. The assembly doors are closed. Contaminated solid waste materials have been placed into the waste chamber and the safety gate has been locked upon power activation. An appropriate chemical agent may be added to the waste chamber prior to or with the waste materials. FIG. 2B shows the batch cycle in progress after chemical agent addition verification. The cutting heads start to rotate and the hydraulically driven ramplate forces the waste materials towards the cutting heads. The waste materials are repeatedly shredded, sheared and cut into smaller pieces. The waste materials are mixed with the chemical treatment agent if introduced into the machine. Following a pre-set time interval, the waste materials are completely physically destroyed and homogeneously mixed with the chemical agent(s), as shown in FIG. 2C. Then, FIG. 2D shows the assembly doors are opened. The cutting heads continue to rotate while the doors are opened to allow all the shredded material to fall into the container below the cutting heads. The physically destroyed and chemically treated waste materials are dumped into a plastic lined box positioned below the shredding/shearing assembly. The box containing the waste material, now shredded and greatly reduced in volume, is disposed of appropriately. Then the cycle may be repeated.

The apparatus has been described as hydraulically operated. Other means of operation may be used where appropriate.

The cutting heads of the apparatus can be operated at about 10 to 500 rpm. For many waste materials, operating speeds of about 80 to 300 rpm are appropriate. Processing a batch of waste may take about 1 to 10 minutes. Many types of waste material may be processed in 3 to 5 minutes. Batches are generally up to about 80 lbs. in weight, but may be up to several hundred pounds in a large capacity apparatus.

While the invention has been described with respect to certain embodiments thereof, variations and modifications may be made without departing from the spirit and scope of the invention.

What is claimed is:

1. A method of grinding waste material comprising:

passing the waste material into a chamber;

grinding the waste material between two cutting heads rotating in opposite directions, said cutting heads comprising alternating cutting blades and spacers, each of said cutting heads interdigitating closely with the other, grinding the waster material between said alternating cutting blades and spacers and alternating grooves sized to interdigitate closely with said cutting blades and spacers formed in a pair of curved doors located below said interdigitating cutting heads for releasing the ground waste material, circulating all of said waste material being ground between end surfaces of said cutting blades and spacers of said two interdigitating cutting heads spaced away from each other and from cooperating surfaces of said grooves in said pair of curved doors only sufficiently to allow said waste material to circulate between said cutting heads and said grooves in said doors;

opening the curved doors;

removing the waste material from said chamber through the opened doors.

2. A method according to claim 1 further comprising ramming said waste material against said cutting heads.

3. A method according to claim 1 further comprising adding chemical disinfectant to the waste material.

4. A method according to claim 1 further comprising grinding the waste material sufficiently to render components of said waste material unrecognizable.

5. A method according to claim 4 further comprising reducing the volume of the waste material during the grinding step to about 15 to 25 percent of its original volume.

6. A method according to claim 1 further comprising circulating and recirculating the waste material between the interdigitating cutting heads and the adjacent doors.

7. A method according to claim 1 further comprising reversing the direction of rotation of the cutting heads.

8. A method according to claim 1 further comprising reducing the volume of the waste material during the grinding step.

9. Apparatus for processing solid waste comprising:

a chamber for receiving solid waste;

a plurality of heads for cutting said waste, each cutting head comprising an elongated rotating shaft and a plurality of cutting blades separated by means for spacing said cutting blades from each other mounted on said shaft, wherein adjacent cutting heads mesh together whereby cutting blades of one cutting head interdigitate with spacing means of an adjacent cutting head; and curved door means for closing said chamber adjacent said cutting heads when said waste is being cut and for opening said chamber for releasing the cut waste, wherein said door means comprises a plurality of first curved groove means for receiving cutting edges of said cutting blades and a plurality of second curved groove means for said spacing means;

wherein said plurality of first and second curved groove means of said curved door means interdigitate with said cutting blades and spacing means of said cutting heads.

10. Apparatus according to claim 9 further comprising fixed means for receiving said cutting edges of said cutting heads, wherein said fixed means comprises third groove means continuous with said first groove means and fourth groove means continuous with said second groove means.

11. Apparatus according to claim 9 wherein said door means is positioned closely adjacent to and curved to conform with outer edges of said adjacent cutting heads.

12. Apparatus according to claim 10 wherein said fixed means is positioned closely adjacent to and curved to conform with outer edges of said cutting heads.

13. Apparatus for processing solid waste material comprising:

a chamber for receiving solid waste;

a plurality of heads for cutting said waste material, each cutting head comprising an elongated rotating shaft and a plurality of cutting blades separated by means for spacing said cutting blades from each other mounted on said shaft, wherein adjacent cutting heads mesh together whereby cutting blades of one cutting head interdigitate with spacing means of an adjacent cutting head;

curved door means for closing said chamber adjacent said cutting heads when said waste is being cut and for opening said chamber for releasing the cut waste material, wherein said door means comprises a plurality of first groove means for receiving cutting edges of said cutting blades and a plurality of second groove means for receiving said spacing means; and ram means for forcing said waste material toward said cutting heads.

14. Apparatus according to claim 13 wherein the effective size of said chamber is reduced when said ram means forces said waste material toward said cutting heads.

15. Apparatus for processing solid waste comprising:

a chamber for receiving solid waste;

a plurality of heads for cutting the waste, each cutting head comprising an elongated rotating shaft and a plurality of cutting blades alternating with spacers for separating said cutting blades from each other mounted on said shaft, wherein adjacent cutting heads interdigitate together, whereby cutting blades of one cutting head are aligned with spacers of an adjacent cutting head, a pair of doors for closing said chamber adjacent said cutting heads when the waste is being cut and for opening said chamber for releasing the cut waste, wherein each of said doors comprise a plurality of first grooves for receiving cutting edges of said cutting blades and a plurality of second grooves for receiving said spacers, wherein end surfaces of said cutting blades and spacers of said interdigitating cutting heads are spaced away from cooperating surfaces of said first and second grooves in said pair of doors only sufficiently to allow said waste to circulate between said cutting heads and said grooves in said doors, and wherein end surfaces of said cutting blades and spacers of a first of said interdigitating cutting heads are spaced away from end surfaces of adjacent spacers and cutting blades respectively of a second of said interdigitating cutting heads only sufficiently to allow said waste to circulate between said cutting heads.

16. Apparatus according to claim 15 further comprising a fixed plate contiguous with said doors for receiving said cutting edges of said cutting heads, wherein said fixed plate comprises third grooves contiguous with said first grooves and fourth grooves contiguous with said second grooves.

17. Apparatus according to claim 16 wherein said fixed plate is positioned closely adjacent to and curved to conform with outer edges of said cutting heads.

18. Apparatus according to claim 15 wherein said doors are positioned closely adjacent to and curved to conform with outer edges of said adjacent cutting heads.

19. Apparatus according to claim 15 further comprising a ram for forcing said waste material toward said cutting heads.

* * * * *